US009424693B2

(12) United States Patent
Rodrigues

(10) Patent No.: US 9,424,693 B2
(45) Date of Patent: Aug. 23, 2016

(54) MAINTENANCE PLANNING OPTIMIZATION FOR REPAIRABLE ITEMS BASED ON PROGNOSTICS AND HEALTH MONITORING DATA

(71) Applicant: Embraer S.A., Sao Jose dos Campos-SP (BR)

(72) Inventor: Leonardo Ramos Rodrigues, Sao Jose dos Campos (BR)

(73) Assignee: EMBRAER S.A., Sao Jose dos Campos (BR)

( * ) Notice: Subject to any disclaimer, the term of this patent is extended or adjusted under 35 U.S.C. 154(b) by 0 days.

(21) Appl. No.: 14/202,388

(22) Filed: Mar. 10, 2014

(65) Prior Publication Data

US 2015/0254908 A1 Sep. 10, 2015

(51) Int. Cl.
*G07C 5/00* (2006.01)
*G07C 5/08* (2006.01)

(52) U.S. Cl.
CPC ..... *G07C 5/0808* (2013.01); *G07C 5/006* (2013.01)

(58) Field of Classification Search
CPC ..... G07C 5/006; G07C 5/0808; G06Q 10/06315; G06Q 10/06
See application file for complete search history.

(56) References Cited

U.S. PATENT DOCUMENTS

| | | | | |
|---|---|---|---|---|
| 4,414,539 | A | 11/1983 | Armer | |
| 5,467,268 | A * | 11/1995 | Sisley et al. | 705/7.16 |
| 5,890,134 | A * | 3/1999 | Fox | 705/7.24 |
| 5,913,201 | A * | 6/1999 | Kocur | 705/7.17 |
| 6,442,459 | B1 | 8/2002 | Sinex | |
| 6,657,429 | B1 | 12/2003 | Goldfine et al. | |
| 7,447,598 | B2 | 11/2008 | Malkin et al. | |
| 7,502,747 | B1 * | 3/2009 | Pardo et al. | 705/7.13 |
| 7,558,639 | B2 | 7/2009 | Rassaian et al. | |
| 2003/0088373 | A1 | 5/2003 | Fields et al. | |
| 2003/0111525 | A1 | 6/2003 | Sweeney et al. | |
| 2004/0162811 | A1 | 8/2004 | Wetzer et al. | |
| 2004/0176887 | A1 | 9/2004 | Kent et al. | |
| 2006/0074609 | A1 * | 4/2006 | Freeman et al. | 703/1 |
| 2007/0010923 | A1 | 1/2007 | Rouyre | |
| 2008/0172268 | A1 * | 7/2008 | Wingenter | 705/7 |
| 2009/0063237 | A1 * | 3/2009 | Harvey et al. | 705/8 |
| 2009/0133026 | A1 * | 5/2009 | Aggarwal et al. | 718/103 |
| 2009/0133381 | A1 | 5/2009 | Holmes et al. | |
| 2009/0240468 | A1 | 9/2009 | Torng | |
| 2009/0259411 | A1 | 10/2009 | Loomis et al. | |
| 2010/0010856 | A1 * | 1/2010 | Chua et al. | 705/8 |

(Continued)

OTHER PUBLICATIONS

Sherbrooke, Craig C., Optimal Inventory Modeling of Systems: Multi-Echelon Techniques, Second Edition, Chapter 2 Single-Site Inventory Model for Repairable Items, Sections 2.6 Stock Level and 2.7 Item Performance Measures, 2004, pp. 24-28.

(Continued)

*Primary Examiner* — Mussa A Shaawat
(74) *Attorney, Agent, or Firm* — Nixon & Vanderhye P.C.

(57) ABSTRACT

Maintenance interventions are planned using RUL (Remaining Useful Life) estimations obtained from a PHM (Prognostics and Health Monitoring) system as well as estimations of spare parts availability. PHM information is used to verify whether spare parts will be available when the next failures are expected to occur, and expected RUL of a component or system based on a set of measurements collected from the aircraft systems can be used to schedule repair times that do not conflict with other repairs to avoid wait time and maximize repair shop capacity utilization.

14 Claims, 5 Drawing Sheets

(56) References Cited

U.S. PATENT DOCUMENTS

| | | | | |
|---|---|---|---|---|
| 2010/0042283 | A1* | 2/2010 | Kell et al. | 701/29 |
| 2014/0121885 | A1 | 5/2014 | Schoonveld | |

OTHER PUBLICATIONS

Vachtsevanos, George, et al., Intelligent Fault Diagnosis and Prognosis for Engineering Systems, First Edition, Chapter 6 Fault Prognosis, Section 6.1 Introduction, 2006, pp. 284-289.

Dekker, Rommert, "Applications of maintenance optimization models: a review and analysis," Reliability Engineering and System Safety, 1996, vol. 51, pp. 229-240.

Fritzsche, Roy, et al., "An Integrated Logistics Model of Spare Parts Maintenance Planning within the Aviation Industry," International Science Index, 2012, vol. 6, No. 8, pp. 1-10.

Lee, Loo Hay, et al., "Multi-objective simulation-based evolutionary algorithm for an aircraft spare parts allocation problem," European Journal of Operational Research, 2008, vol. 189, pp. 476-491.

Perlman, Yael, et al., "Modeling Multi-Echelon Multi-Supplier Repairable Inventory Systems with Backorders," J. Service Science & Management, 2010, vol. 3, pp. 440-448.

Related U.S. Appl. No. 13/335,268, filed Dec. 22, 2011.

* cited by examiner

MAINTENANCE PLANNING OPTIMIZATION FOR REPAIRABLE ITEMS BASED ON PROGNOSTICS AND HEALTH MONITORING DATA

CROSS-REFERENCE TO RELATED APPLICATIONS

None.

STATEMENT REGARDING FEDERALLY SPONSORED RESEARCH OR DEVELOPMENT

None.

FIELD

The technology herein relates to processing systems for automatically scheduling repair of aircraft components to avoid failure and minimize wait time.

BACKGROUND

Maintenance planning plays an important role in assets management especially when it directly affects asset availability. In the aviation industry, maintenance planning becomes even more important due to safety aspects, the high availability expectations from aircraft operators and the high costs incurred when an aircraft needs to be taken out of service for repair. Gathering and combining all of the relevant information to generate an optimized maintenance planning is not a simple task.

Repairable items are, generally speaking, components or assets that, after a failure, are submitted to a repair cycle to be used again instead of being discarded. This implies that a repairable item spare part inventory system uses a repair shop where failed components are repaired, as well as a warehouse where spare parts are stocked.

Only certain repair shops are permitted to repair aircraft. Repair shops must comply with stringent training and certification standards to ensure that proper procedures are followed. Since aircraft are mobile, they can be flown to a repair shop with appropriate repair capacity and capabilities when routine maintenance becomes necessary. However, if a critical component fails, the aircraft may need to be grounded and repaired in place. Some repairable aircraft components are very large and/or require involved repair procedures by skilled repair technicians. For example, some repair shops will not have sufficient staff and/or space to repair more than one large fuselage piece or other large aircraft structure at a time. Hangar and associated workspace may be limited, and machines and equipment necessary to repair such components may be expensive so that a given repair shop may have only one set of equipment to work on a single component at a time. Such components might include for example flight control surfaces and sidewall panels; large structures including sheet metal and floorboards; interior components such a galleys, lavatories, cargo nets, seats, and class dividers; and accessories such as pumps, propellers, and toilet tanks.

Mathematical models for optimizing the performance of repairable components based on maintenance interventions have been widely discussed in the literature. An overview of maintenance models for repairable items is presented in Dekker, R., Applications of Maintenance Optimization Models: A Review and Analysis, Reliability Engineering and Systems Safety, Volume 51 (1996), incorporated by reference. Planning maintenance interventions can be a complex task because there are many variables involved. Gathering and combining all this information in order to generate an optimized maintenance plan is a challenge faced by maintenance planners.

BRIEF DESCRIPTION OF THE DRAWINGS

The following detailed description of example non-limiting illustrative embodiments is to be read in conjunction with the drawings of which.

DETAILED DESCRIPTION

Figure 1:
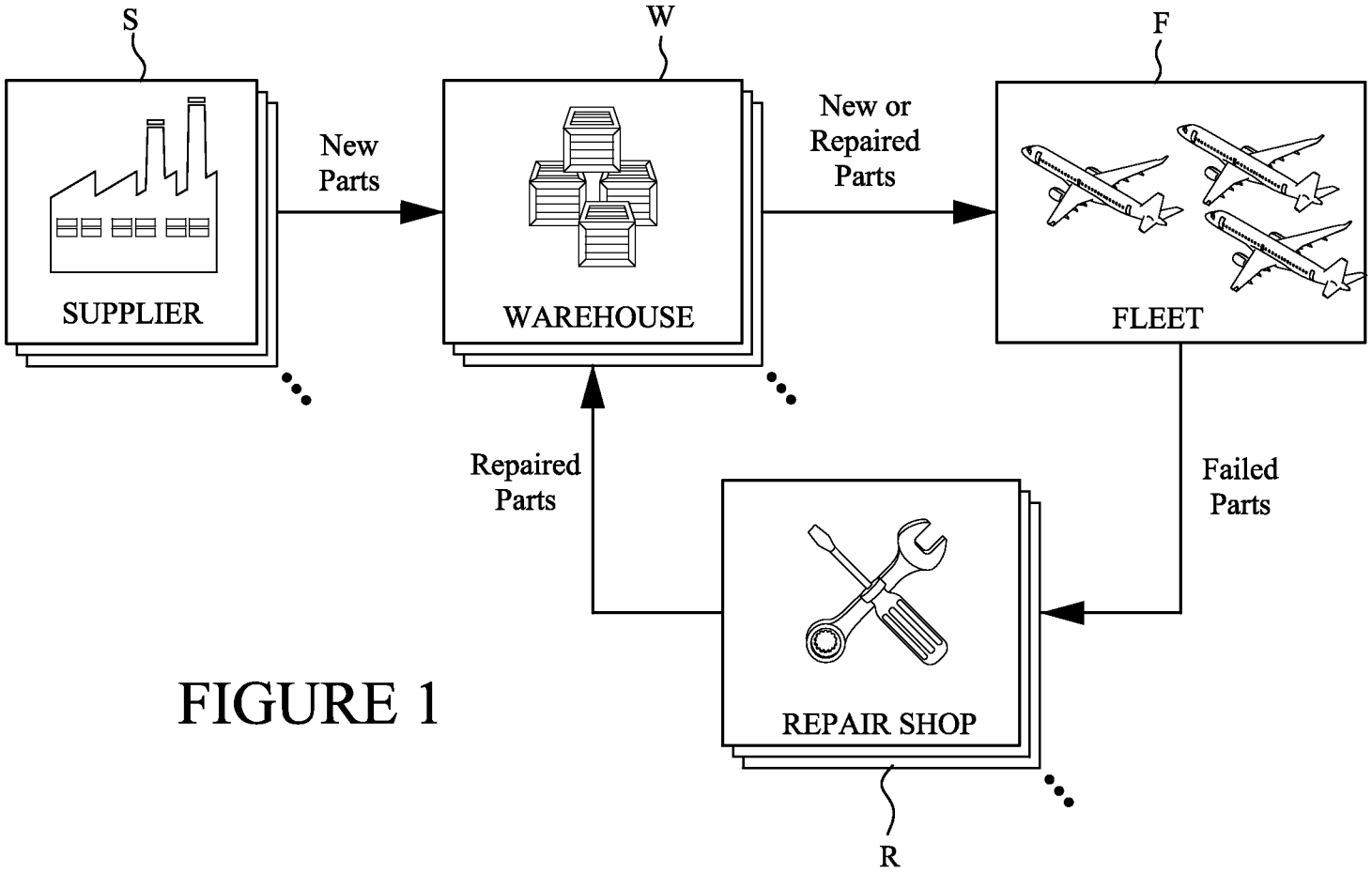
FIG. 1 shows a typical non-limiting spare parts inventory system for repairable items.

FIG. 1 shows a typical non-limiting spare parts inventory system for repairable items. The supplier S provides spare parts to warehouse W. Then spare parts stay in the inventory system moving from the warehouse W to the fleet F, from the fleet to the repair shop R and from the repair shop back to the warehouse. In the example non-limiting inventory system shown in FIG. 1, spare parts are bought from a supplier S and delivered to a warehouse W. There of course can be multiple suppliers S and/or multiple warehouses W. When a component installed on an aircraft fails, it is removed and sent to a repair shop R to be repaired. The faulty component is replaced by a new one obtained from a warehouse W. If there is no spare part in the warehouse W, the aircraft (F) may be grounded until a new part is provided. Once a faulty component arrives in (or can be fabricated by) the repair shop R, it is submitted to the repair process. When the repair process ends, the repaired component is sent to the warehouse W and stays there until a new failure occurs in the field.

The example non-limiting technology herein presents a new model to plan maintenance interventions, using RUL (Remaining Useful Life) estimations obtained from a PHM (Prognostics and Health Monitoring) system as well as estimations of spare parts availability. PHM information is used to verify whether spare parts will be available when the next failures are expected to occur. It is assumed in at least some non-limiting example embodiments that every maintenance intervention requires a spare part order to be performed (of course some repairs do not require spare parts, but many do).

"PHM" can be defined as the ability of assessing the health state, predicting impending failures and forecasting the expected RUL of a component or system based on a set of measurements collected from the aircraft systems. PHM can comprise for example a set of techniques which use analysis of measurements to assess the health condition and predict impending failures of monitored equipment or system(s). In one example non-limiting implementation, such techniques and analysis can be performed automatically using a data processing system that executes software stored in non-transitory memory.

Figure 4A:
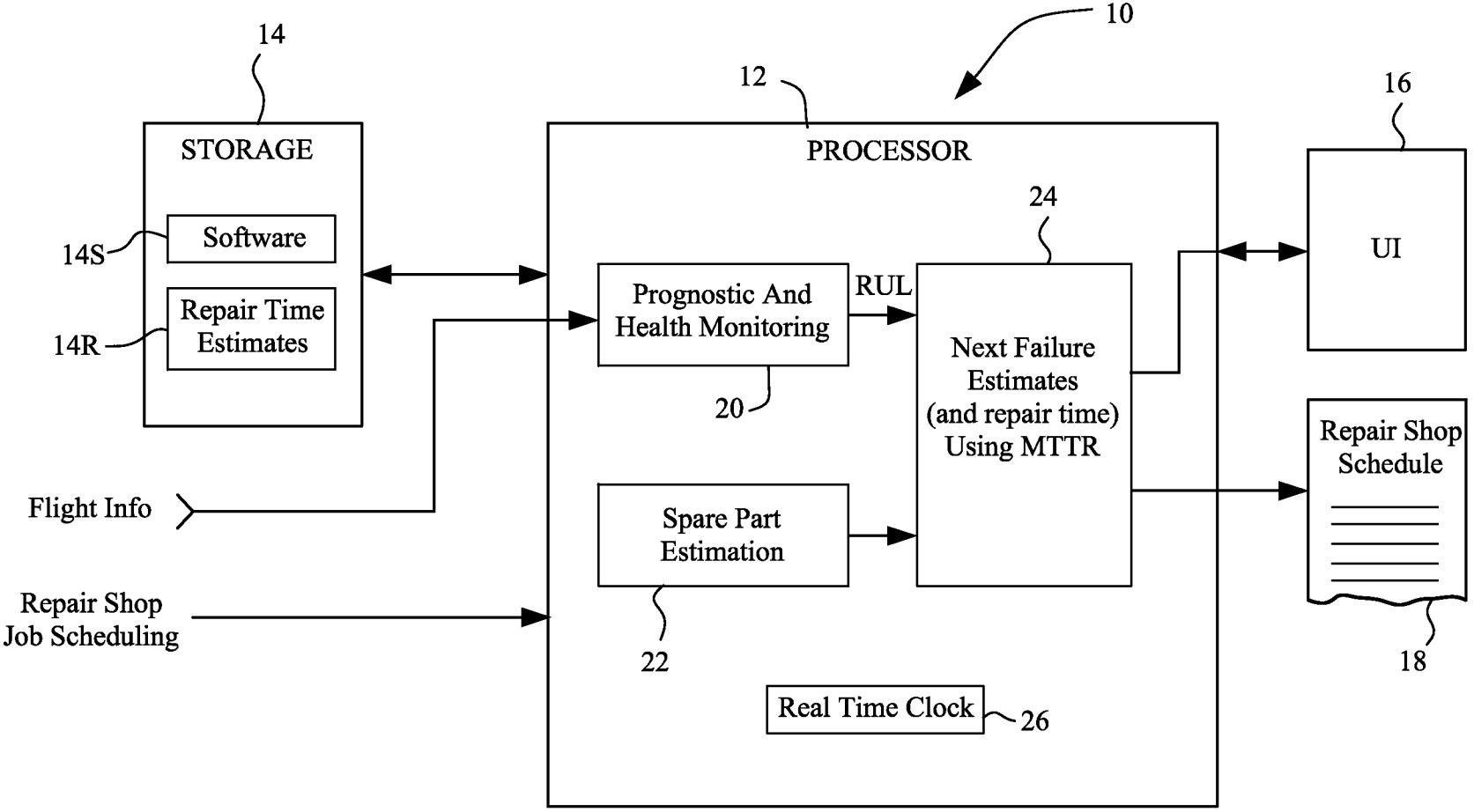
FIG. 4A shows an example data processing system.

FIG. 4A shows a suitable data processing system providing functionality described above. A processor 12 is connected to non-transitory memory 14 storing program instructions that when executed by the processor perform functions including prognostics and health monitoring 20, spare part estimations 22 and next failure estimates using MTTR 24. Processor 12 also has a real time clock 26 that informs it of the current time and date. In one example non-limiting implementation, storage 14 stores software 14S to be executed by the processor 12 and a table of repair time estimates, i.e., how long, on average, it generally takes to repair a particular component. The table of repair time estimates 14R may in one embodiment be based on actual repair times for a particular repair shop R.

The processor 12 can also receive inputs from and generate outputs to a user interface 16, receives inputs from flight schedules from fleet F, and can generate a repair schedule 18 to be dispatched to a particular repair shop R and to the fleet F to schedule repairs before failures occur and in a way to maximize repair shop utilization to avoid waiting and down time.

At least one health monitoring algorithm can be developed for each monitored system. Each algorithm processes relevant data (e.g., flight info from fleet F, FIG. 4B block 52) and generates a degradation index that indicates how degraded the monitored system is (block 54). A degradation index can be generated for each flight leg or for a defined period of time (a day, a week, etc.).

Figure 2:
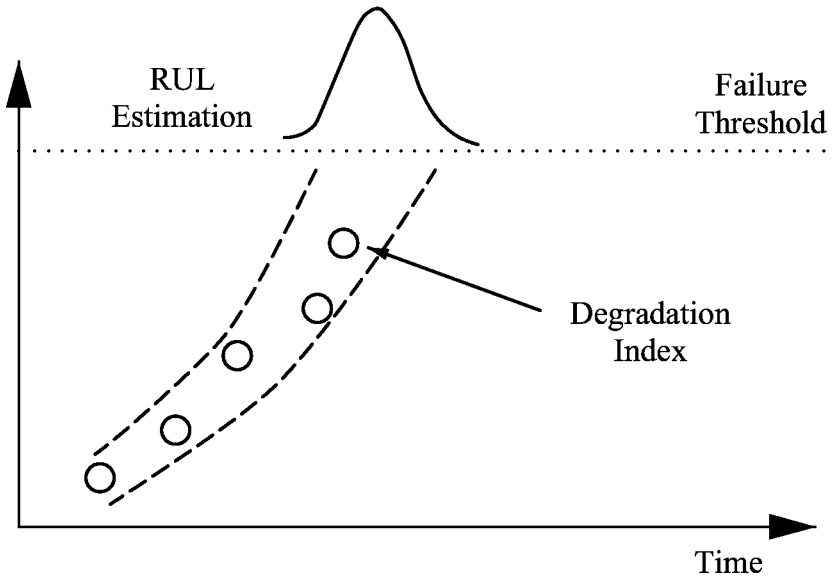
FIG. 2 shows an example non-limiting evolution of the degradation index of a component monitored by a PHM system, the failure threshold and the estimated Remaining Useful Life probability distribution.

In many cases it is possible to establish a threshold that defines the system failure (see FIG. 2). When the failure threshold is known, it is possible to extrapolate the curve generated by the evolution of the degradation index over time and estimate a time interval in which the failure is likely to occur (block 56). This estimation is able to be represented as a probability density function, as illustrated in FIG. 2. Such a probability density function may have a Gaussian or other distribution, as is well known in the art.

Since spare parts are finite resources, the example non-limiting model proposed herein reduces the probability that multiple similar components will fail in a short period of time because, when it happens, there is not enough time to repair all failed components and fleet availability is penalized. To avoid this situation, the proposed model anticipates some replacements and schedules maintenance in advance not only of when the component will fail, but also in advance of attainment of the failure threshold based on degradation index as FIG. 2 shows, in order to optimize use of repair shop availability and avoid conflicts of the repair shop repairing a particular component when it is already at (or has exceeded) full capacity to repair such components.

Figure 3A:
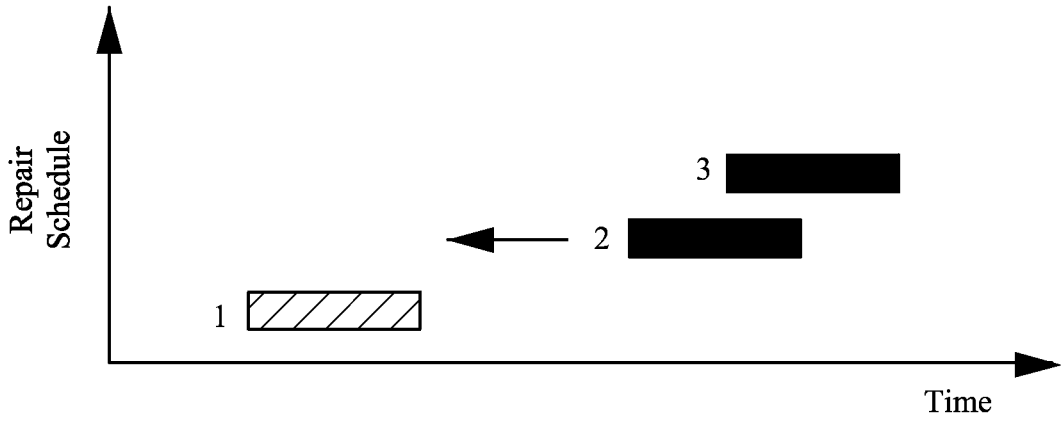
FIGS. 3A, 3B show non-limiting examples of expected repair shop time schedules, built based on RUL estimations obtained from a PHM system and the MTTR of the monitored components.
Figure 3B:
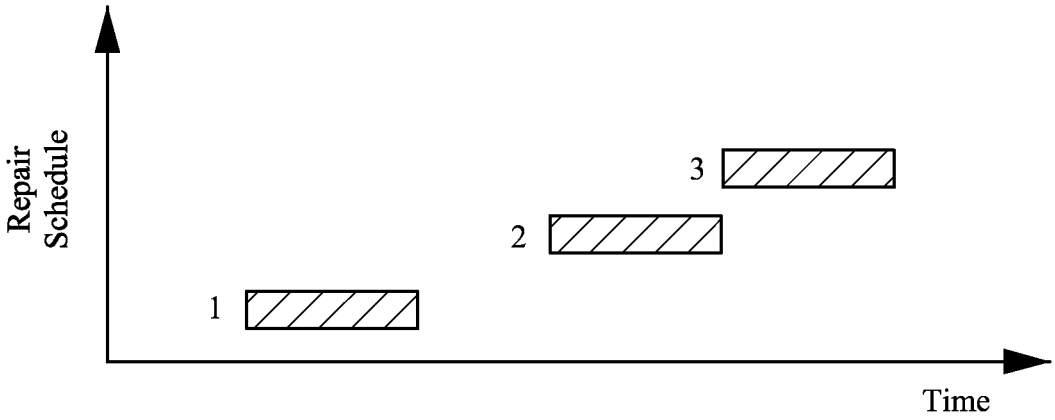

In one example non-limiting embodiment, RUL estimations obtained from the PHM system 20 are used to estimate when the next failures are likely to occur (block 58). The MTTR (Mean Time to Repair) of the monitored components is used to estimate the repair duration (block 58). In other words, when RUL estimations and the MTTR are combined (in some cases with job scheduling of a particular repair shop), it is possible to estimate when the monitored components will be sent to the repair shop and how long they will stay there. So, it is possible to build an expected repair schedule for each component type, as illustrated in FIGS. 3A, 3B.

Suppose $S_X$ is the number of spare parts of component X and $R_X(t)$ is the number of components X in the repair shop at instant t. The number of aircraft grounded waiting for a component X at instant t, $G_X(t)$, can be calculated as a function of $R_X(t)$ and $S_X$ as follows:

$$G_x(t) = \begin{cases} 0; & R_x(t) \le S_x \\ R_x(t) - S_x; & R_x(t) > S_x \end{cases} \quad (1)$$

In Eq. (1), it can be seen that fleet availability is affected by component X only when there are more than $S_X$ components simultaneously in the repair shop. Depending on the type of component, $S_X$ can be any integer including 1 (for example, if a large component requires use of the only available hangar space).

FIG. 3A shows an example of a repair shop time schedule for a component X. Each bar in FIG. 3 represents the repair cycle of one component of type X. Let's assume that the number of spare parts for component X, $S_X$, is 1. It can be observed in FIG. 3A that the third component is expected to arrive in the repair shop while the second component is still being repaired. In this situation, there would be two components simultaneously in the repair shop. During this time, $R_X(t)$ is 2, and according to Eq. (1), $G_X(t)$ is 1. In other words, there would be one aircraft grounded waiting for a component X.

In order to reduce the probability that multiple similar components will be simultaneously in the repair shop, some components can be replaced earlier. When some replacements are anticipated, the period of time in which aircraft are grounded can be reduced or even eliminated. In the example illustrated in FIG. 3A, if the replacement of component 2 is anticipated, it is possible for processor 12 to take into account the amount of time it takes to repair a particular component and to generate a new time schedule in which the maximum number of components in the repair shop never exceeds 1 (or whatever other limit a particular repair shop R's capacity imposes based for example on the number of workspaces, skilled employees, and/or other parameters affecting the capacity of the particular repair shop R to repair this particular type of component).

A new example non-limiting time scheduled is shown in FIG. 3B. As can be seen, this new schedule moves up when repair "2" is to be performed to avoid conflicting with repair "3", while also preventing repair "2" from being performed too early by scheduling the end of repair "2" to coincide with the beginning of repair "3".

Figure 4B:
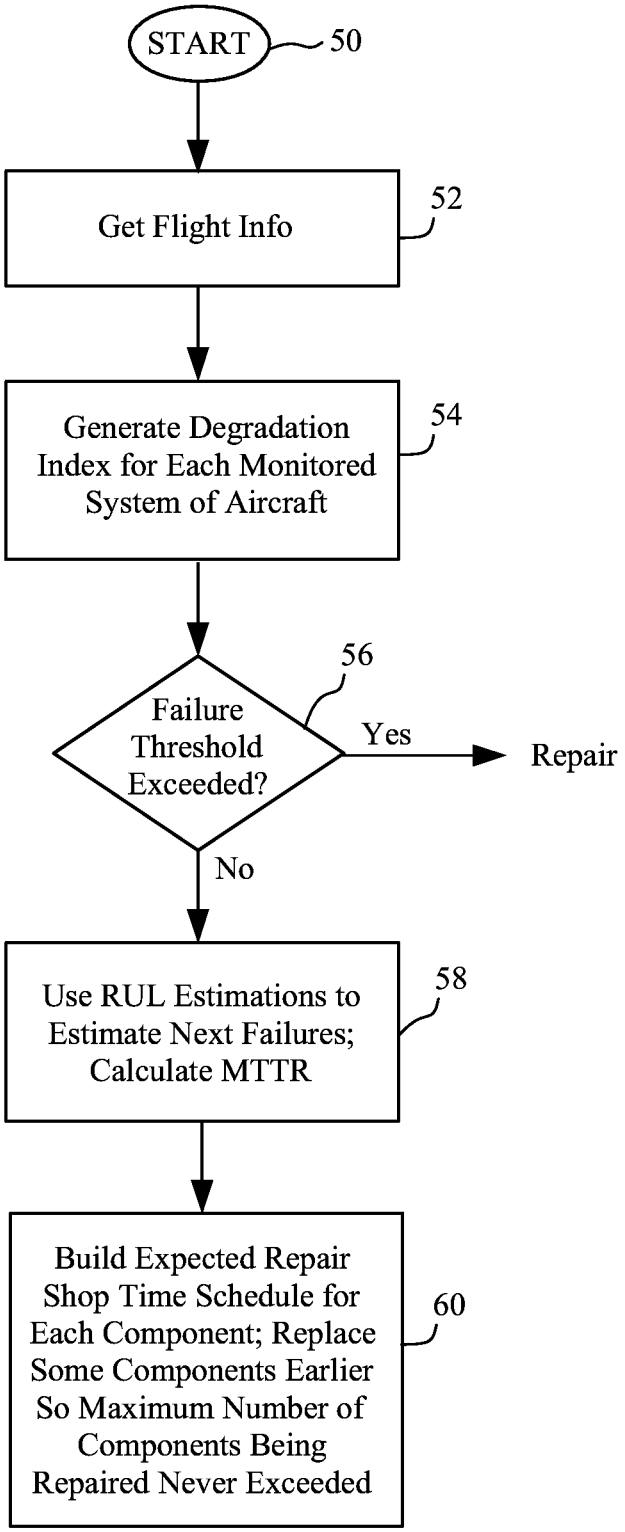
FIG. 4B shows example non-limiting processing steps.

Processor 12 can thus perform FIG. 4B block 60 to automatically generate a repair shop schedule 18 that it dispatches to the repair shop S and the fleet F, to effect early repair of components before they fail and before the repair shop is likely to be engaged in repairing another unit(s) of the same or different component(s) that would cause a conflict such that a needed repair would have to be queued.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A system for scheduling repair of a component of an aircraft before the component fails, comprising:

at least one processor; and a non-transitory memory coupled to the processor, the non-transitory memory storing program control instructions that when executed by the processor cause the processor to:

(a) use a degradation value to estimate the probability that a component of an aircraft will fail;

(b) estimate how long it will take to repair the aircraft component;

(c) determine availability of resources for repairing the aircraft component including whether said repair resources will be needed to repair the same component of other aircraft; and (d) schedule repair of the aircraft component in advance of (a) when the aircraft component fails and (b) attaining a failure threshold based on the degradation index, to minimize conflicts of the scheduled repair of the aircraft component with repairs of other aircraft components to better use repair shop availability and avoid conflicts when the repair shop is already at or has exceeded capacity.

2. The system of claim 1 wherein the processor is configured to determine the availability of resources for repairing the aircraft component by calculating the number of aircraft grounded waiting for a component X at instant t, $G_X(t)$, as a function of $R_X(t)$ and $S_X$ as follows:

$$G_x(t) = \begin{cases} 0; & R_x(t) \le S_x \\ R_x(t) - S_x; & R_x(t) > S_x \end{cases}$$

where $S_X$ is the number of spare parts of component X and $R_X(t)$ is the number of components X in a repair shop at instant t.

3. The system of claim 1 wherein the processor is further configured to estimate component failure by calculating MTTR (Mean Time to Repair) of the component.

4. The system of claim 1 wherein the processor is further configured to determine the availability of resources for repairing the aircraft component by anticipating replacement and automatically scheduling maintenance in advance not only of when the component will fail, but also in advance of attainment of the failure threshold based on the degradation index, in order to optimize use of repair shop availability and avoid conflicts when the repair shop is already at or has exceeded full capacity to repair said component.

5. The system of claim 1 wherein the processor is further configured to determine the availability of resources for repairing the aircraft component by taking into account the amount of time it takes to repair the component and to generate a repair schedule in which the maximum number of said components in the repair shop never exceeds a predetermined limit on a repair shop's capacity to repair said component.

6. The system of claim 1 wherein the processor is further configured to determine how long it will take to repair the aircraft component by extrapolating a curve generated by the evolution of the degradation index over time to estimate a time interval in which the failure is predicted to occur.

7. The system of claim 6 wherein the estimate is represented as a probability density function.

8. A method for scheduling repair of an aircraft component before the component fails, comprising:

using at least one processor, predicting when a component of an aircraft will fail based at least in part by calculating a degradation index and a statistical probability distribution;

using the processor, estimating how long it will take to repair the aircraft component;

using the processor, determining availability of resources for repairing the aircraft component including predicting whether said repair resources will be needed to repair the same component for other aircraft; and using the processor, scheduling repair of the aircraft component before (a) the aircraft component fails and (b) attains a failure threshold based on the degradation index, to minimize conflicts of the scheduled repair of the aircraft component with repairs of other aircraft components to better use repair shop availability, so the scheduled repair does not conflict with repair of the component for other aircraft when the repair shop is already at or has exceeded capacity.

9. The method of claim 8 wherein the processor determines availability of resources for repairing the aircraft component by calculating the number of aircraft grounded waiting for a component X at instant t, $G_X(t)$, as a function of $R_X(t)$ and $S_X$ as follows:

$$G_x(t) = \begin{cases} 0; & R_x(t) \le S_x \\ R_x(t) - S_x; & R_x(t) > S_x \end{cases}$$

where $S_X$ is the number of spare parts of component X and $R_X(t)$ is the number of components X stocked by at least one repair shop at instant t.

10. The method of claim 8 further including the processor predicting when the component will fail by estimating MTTR (Mean Time to Repair) of the component.

11. The method of claim 8 wherein the processor determines availability of resources for repairing the aircraft component including predicting whether said repair resources will be needed to repair the component for other aircraft by anticipating replacements and automatically scheduling maintenance in advance not only of when the component will fail, but also in advance of attainment of the failure threshold based on the degradation index, in order to optimize use of repair shop availability and avoid conflicts between the repair shop repairing a particular component when it is already at or has exceeded full capacity to repair such components.

12. The method of claim 8 further including the processor taking into account the amount of time it takes to repair the component and to generate a repair schedule in which the maximum number of the components in the repair shop never exceeds a predetermined limit on a repair shop's capacity to repair the component.

13. The method of claim 8 wherein the processor extrapolates a curve generated by the evolution of the degradation index over time to estimate a time interval in which the failure is likely to occur.

14. The method of claim 8 wherein the estimate is represented as a probability density function.

* * * * *